US010232200B2

(12) United States Patent
Salm

(10) Patent No.: US 10,232,200 B2
(45) Date of Patent: Mar. 19, 2019

(54) RECESSED CONCRETE ANCHOR

(71) Applicant: Silverline Safety Systems Corp., New Westminster (CA)

(72) Inventor: Roland Salm, New Westminster (CA)

(73) Assignee: SILVERLINE SAFETY SYSTEMS CORP., New Westminster, British Columbia (CA)

( * ) Notice: Subject to any disclaimer, the term of this patent is extended or adjusted under 35 U.S.C. 154(b) by 0 days.

(21) Appl. No.: 15/920,927

(22) Filed: Mar. 14, 2018

(65) Prior Publication Data

US 2018/0264295 A1 Sep. 20, 2018

Related U.S. Application Data

(60) Provisional application No. 62/471,205, filed on Mar. 14, 2017.

(51) Int. Cl.

| | |
|---|---|
| ***A47B 97/06*** | (2006.01) |
| ***A62B 35/00*** | (2006.01) |
| ***E04G 21/32*** | (2006.01) |

(52) U.S. Cl.

CPC ..... *A62B 35/0068* (2013.01); *E04G 21/3204* (2013.01)

(58) Field of Classification Search

USPC ..... 248/205.1

See application file for complete search history.

(56) References Cited

U.S. PATENT DOCUMENTS

| | | | | |
|---|---|---|---|---|
| 2,366,656 A | | 1/1945 | Saffert | |
| 2,623,261 A | * | 12/1952 | Semeraro | E04G 15/00 249/152 |
| 3,298,148 A | * | 1/1967 | Dickson | B64F 1/16 52/166 |
| 3,883,170 A | * | 5/1975 | Fricker | B66C 1/666 294/82.35 |
| 4,367,892 A | * | 1/1983 | Holt | B66C 1/666 294/82.31 |
| 4,386,486 A | * | 6/1983 | Holt | E04G 21/142 52/125.5 |

(Continued)

FOREIGN PATENT DOCUMENTS

| | | |
|---|---|---|
| DE | 29906417 | 9/2000 |
| EP | 2407612 | 1/2012 |

(Continued)

OTHER PUBLICATIONS

Pro-Bel brochure extracts, pp. A-3, A-7, and A-9, undated.

Tractel flyer, entitled "tieback anchors flush type", with a notice of (c) 2004.

*Primary Examiner* — Monica E Millner

(74) *Attorney, Agent, or Firm* — Gavin J. Milczarek-Desai; Quarles & Brady LLP

(57) ABSTRACT

A fall protection permanently embedded safety anchor comprises a unitary housing having outwardly diverging side walls and an interior cavity. Opposed apertures in the side walls receive a uniformly curved retaining bar, the ends of which extend outside the cavity and are embedded in the concrete. The anchor may be easily installed stored and transported and installed in the field. The side walls terminate in an outwardly extending collar that receives a cover that is flush with the surrounding concrete surface.

9 Claims, 6 Drawing Sheets

(56) References Cited

U.S. PATENT DOCUMENTS

| | | | | |
|---|---|---|---|---|
| 4,807,843 | A * | 2/1989 | Courtois | B28B 23/005 249/177 |
| 4,821,994 | A | 4/1989 | Fricker | |
| 5,535,979 | A | 7/1996 | Ellis-Callow | |
| 5,596,846 | A * | 1/1997 | Kelly | E04G 21/142 52/125.2 |
| 6,082,700 | A * | 7/2000 | Lancelot, III | E04G 21/142 249/183 |
| 6,460,824 | B1 | 10/2002 | Lancelot, III et al. | |
| 6,550,834 | B2 | 4/2003 | Fromelius | |
| 6,575,424 | B2 | 6/2003 | Domizio | |
| 6,755,385 | B2 | 6/2004 | Lancelot, III et al. | |
| 7,065,925 | B2 * | 6/2006 | Hansort | E04G 15/04 294/215 |
| 7,222,460 | B2 * | 5/2007 | Francies, III | E04G 15/04 52/125.5 |
| 7,905,063 | B2 * | 3/2011 | Kelly | B66C 1/666 52/125.1 |
| 8,024,896 | B2 * | 9/2011 | Azarin | B28B 23/005 52/125.1 |
| 8,413,400 | B2 * | 4/2013 | Mackay Sim | B28B 7/002 52/576 |
| 8,733,718 | B2 * | 5/2014 | Corsi | E04B 1/40 248/205.1 |
| 8,800,220 | B1 * | 8/2014 | Francies, III | E04G 21/142 249/91 |
| 9,238,155 | B2 | 1/2016 | Borchardt | |
| 2004/0031216 | A1 | 2/2004 | Poldmaa | |
| 2006/0242924 | A1 * | 11/2006 | Kwon | E04B 1/4142 52/704 |
| 2010/0000175 | A1 | 1/2010 | Johnson et al. | |

FOREIGN PATENT DOCUMENTS

| | | |
|---|---|---|
| ES | 2533249 | 4/2015 |
| GB | 2387874 | 10/2003 |

* cited by examiner

RECESSED CONCRETE ANCHOR

FIELD OF THE INVENTION

This invention relates to concrete-embedded safety anchors that are particularly useful in fall protection applications.

BACKGROUND OF THE INVENTION

It is known in the field of fall protection to provide embedded anchors that are cast into a concrete wall or floor for use in attaching safety equipment.

GB2387874 discloses a post type of safety anchor. EP2407612 illustrates an embedded anchor that includes flexible attachment loops that can be tucked into a cavity of the anchor housing after use. ES2533249 and U.S. Pat. No. 9,238,155 disclose anchors having a cylindrical housing.

Another example is the Pro-Bel Model #PBE68 recessed, cast-in-place wall anchor, sold by Pro-Bel Group. The Pro-Bel anchor is a box type safety anchor having a straight reinforcement rod extending through aligned apertures in the box housing and which is tied down with reinforcing rod ties. A disadvantage of the Pro-Bel product is that it is not easily stacked for transport or storage.

The present invention offers an improved cast-in-place permanently embedded safety anchor capable of significant loads, having a housing that is stackable for easy transport and handling and that is simple to install on site.

These and other objects of the invention will be better understood by reference to the detailed description of the preferred embodiment which follows. Note that the objects referred to above are statements of what motivated the invention rather than promises.

Not all of the objects are necessarily met by all embodiments of the invention described below or by the invention defined by each of the claims.

SUMMARY OF THE INVENTION

The invention comprises a fall protection safety anchor having a unitary housing with outwardly diverging side walls, providing for stackability of the housings, and hence easy handling and transport. Preferably the housing is frusto-spherical in shape, or frusto-conical. The side walls include two opposed apertures for receiving a uniformly curved retaining bar, a portion of the curved bar extending in an arc through the cavity and the ends of the bar extending outside the housing on opposite sides thereof for embedment into the concrete. The uniformly curved bar comprises an arc segment of a ring and such shape allows easy installation in the housing on site.

The side walls preferably terminate in an outwardly extending collar having a perimetral flange wall. The top of the flange wall defines the edge of the concrete surface in which the housing is embedded, such that the balance of the housing is recessed in relation to the concrete surface.

The outwardly extending collar includes a channel for receiving protrusions on a cover having a height that causes the top of the cover to be flush with the top of the flange, and therefore flush with the surrounding concrete surface, when the cover is installed.

The housing is preferably made of a plastic such as polypropylene while the retaining bar is preferably made of stainless steel or galvanized mild steel.

The foregoing may cover only some of the aspects of the invention. Other aspects of the invention may be appreciated by reference to the following description of at least one preferred mode for carrying out the invention in terms of one or more examples. The following mode(s) for carrying out the invention is not a definition of the invention itself, but is only an example that embodies the inventive features of the invention.

BRIEF DESCRIPTION OF THE DRAWINGS

At least one mode for carrying out the invention in terms of one or more examples will be described by reference to the drawings thereof in which:

FIG. 1 is a perspective view thereof;

FIG. 2 is a plan view thereof;

FIG. 3 is a side elevation thereof;

FIG. 4 is cross-sectional view along lines 4-4 of FIG. 3;

FIG. 5 is a cross-sectional view along lines 5-5 of FIG. 4;

FIG. 6 is a perspective view thereof;

FIG. 7 is a plan view thereof;

FIG. 8 is a side elevation thereof;

FIG. 9 is a cross-sectional view thereof along 9-9 of FIG. 8;

FIG. 10 is a bottom view thereof;

FIG. 11 is a bottom perspective view thereof;

FIG. 12 is a perspective view of the cover upside down;

FIG. 13 is a bottom view thereof;

FIG. 14 is a plan view thereof;

FIG. 15 is a perspective view of the cover right side up;

FIG. 16 is a side section thereof;

FIG. 17 is a cross-sectional view along 17-17 of FIG. 16;

DETAILED DESCRIPTION OF AT LEAST ONE MODE FOR CARRYING OUT THE INVENTION IN TERMS OF EXAMPLE(S)

Figure 1:
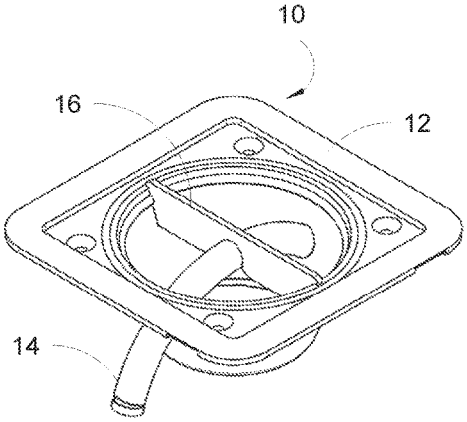
FIGS. 1-5 are views of the anchor assembly according to the preferred embodiment, without the cover, in various views.
Figure 2:
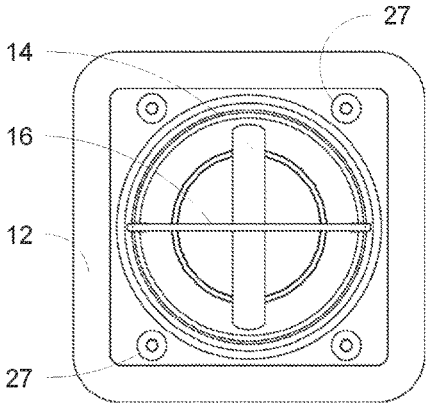
Figure 3:
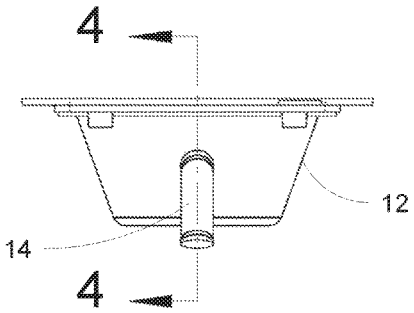
Figure 4:
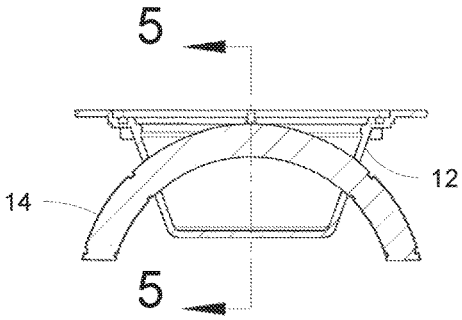
Figure 5:
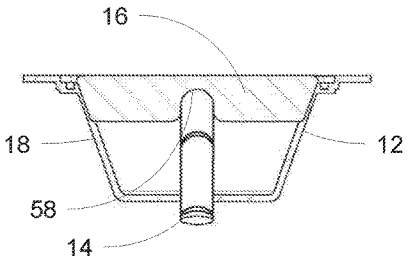
Figure 6:
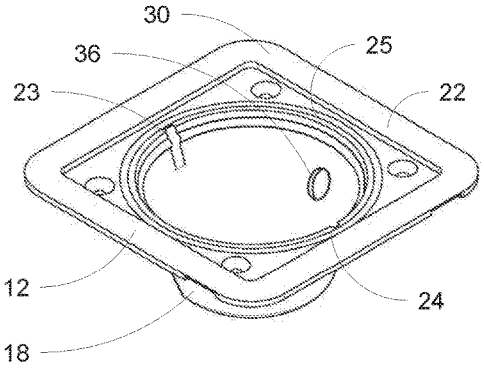
FIGS. 6-11 are views of the housing of the anchor in various views.
Figure 7:
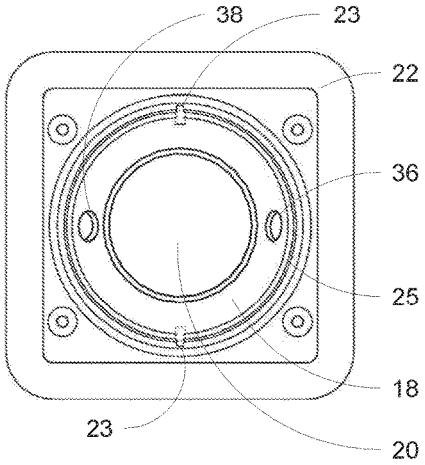
Figure 8:
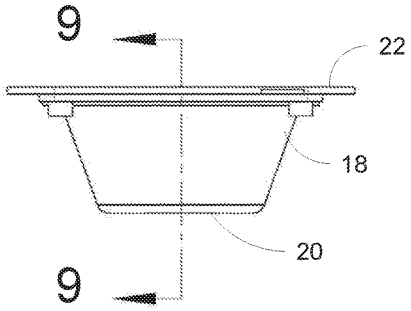
Figure 9:
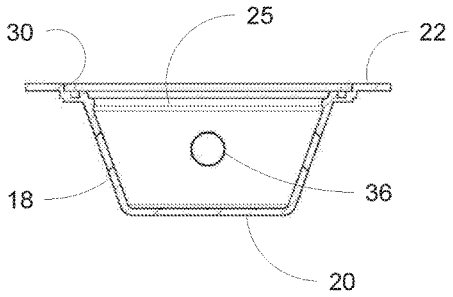
Figure 10:
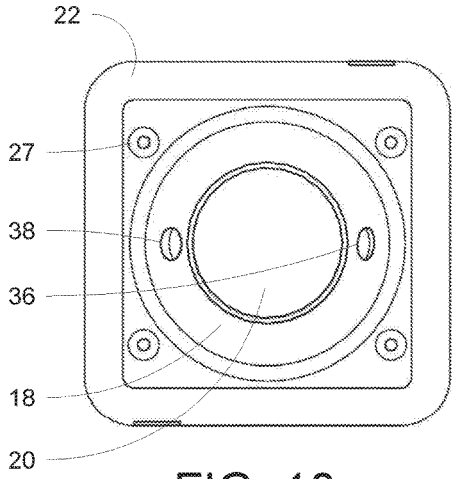
Figure 11:
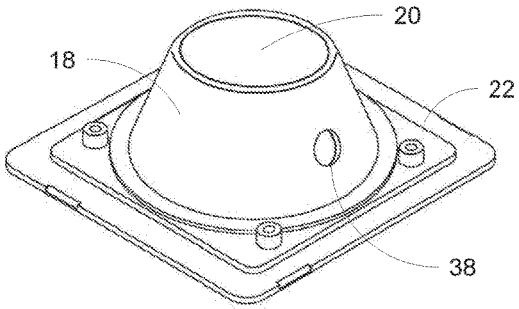
Figure 12:
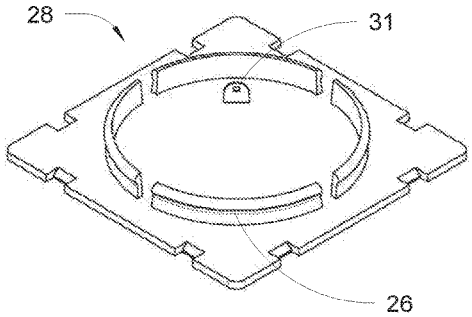
FIGS. 12-17 are views of the cover according to the preferred embodiment, in various views.
Figure 13:
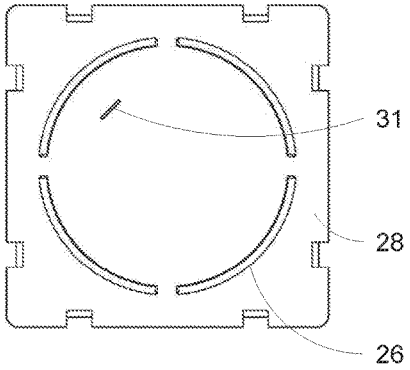
Figure 14:
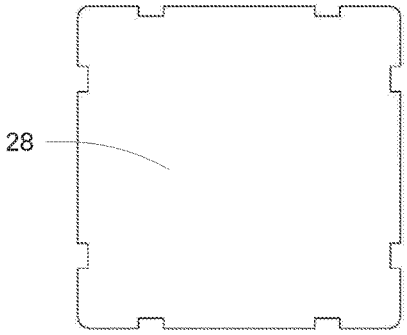
Figure 15:
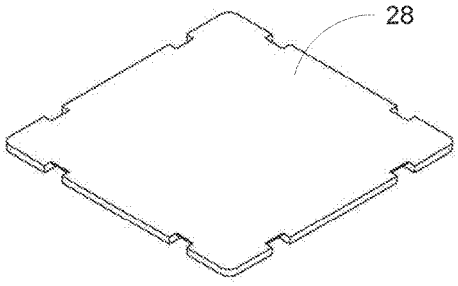
Figure 16:
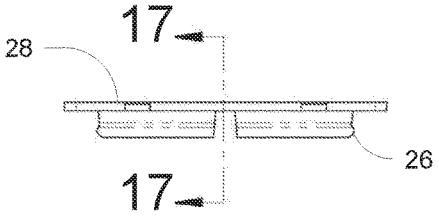
Figure 17:
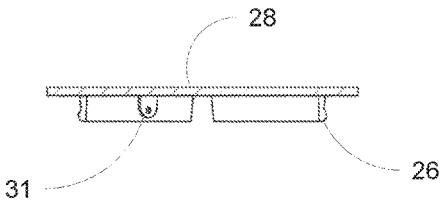
Figure 18:
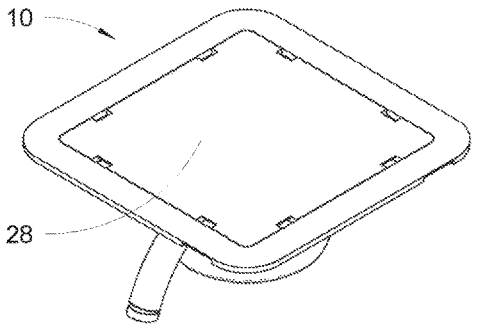
FIG. 18 is a perspective view of the anchor with the cover installed.
Figure 19:
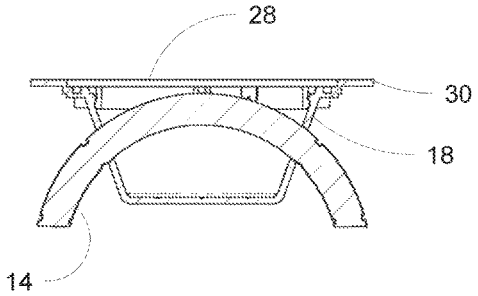
FIG. 19 is a cross-sectional view of the anchor and cover along the center of the retaining bar.
Figure 20:
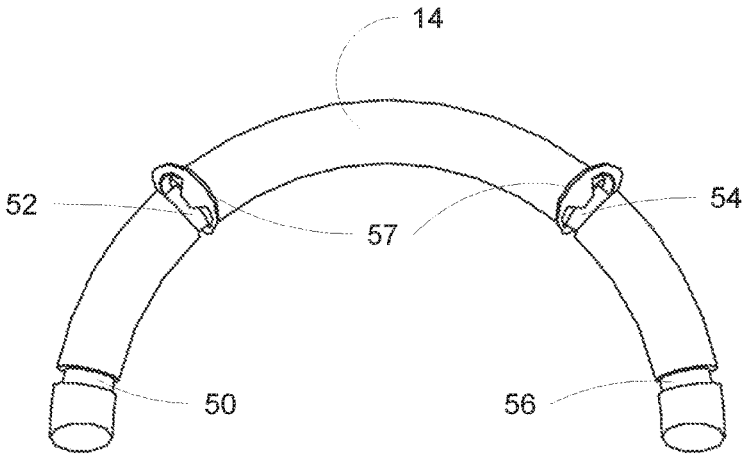
FIG. 20 is an image of the retaining bar with notches and an example retaining clip according to the preferred embodiment; and, FIG. 21 is a cross-sectional view of stacked anchor housings according to the preferred embodiment.

FIG. 1 shows an anchor assembly 10 according to the preferred embodiment of the invention. The assembly 10 generally includes a housing 12, a retaining bar 14 and a bridge bar retainer 16.

Figure 21:
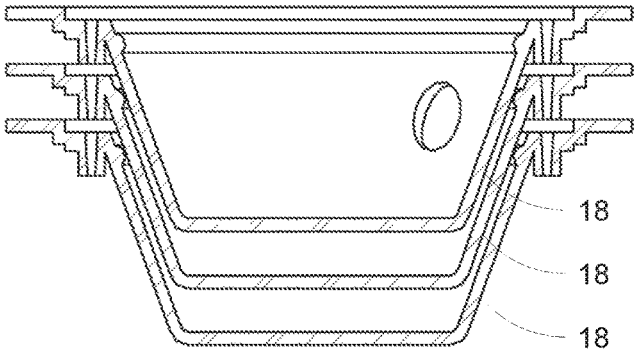

Referring to FIGS. 6 to 11, housing 12 is a single unitary structure having a tapered configuration consisting of a circular side wall 18 that tapers inwardly and downwardly to a flat bottom 20. Conversely, the wall or walls 18 diverge in the upward direction. The upwardly diverging wall 18 enables stacking of the housings, as appreciated by reference to FIG. 21. This facilitates handling and transport of the housings. It is contemplated that the single circular side wall 18 may consist instead of a plurality of upwardly diverging flat walls.

A collar 22 extends outwardly from the top of wall 18 and comprises a channel 24 for receiving an O-ring for waterproofing or water resistance between the housing and the cover. Protrusion 25 on the inside of the housing interlocks with protrusions 26 formed on a removable cover 28 as shown in FIGS. 12 to 19 to create a snap fit when pressure is applied to the lid. Collar 22 includes a number of nail holes 27 that may be used to secure the housing to wood formwork prior to pouring the concrete.

Collar 22 is further provided with a perimetral flange wall 30 such that cover 28 does not extend above the surface of the housing 12 when the cover 28 is installed within the collar 22. The cover 28 is of such a height that when installed, its surface is flush with the top of the flange wall 30 and therefore flush with the surrounding concrete surface in which the housing 12 is embedded. The cover 28 has a tab 31 to which a lanyard can be attached to secure the lid to the bar to prevent misplacement.

Housing 12 includes two apertures 36, 38 in diametrically opposed locations in housing wall 18. Apertures 36, 38 are intended to receive a retaining bar 14 therethrough in the assembled configuration.

Retaining bar 14 is uniformly curved so as to define an arc segment of a circular ring. As a result, the curvature of the retaining bar is consistent throughout its length. This enables the retaining bar to be threaded through one of apertures 36 or 38, through the central cavity of the housing and into the opposed aperture (36 or 38) as is best appreciated by reference to FIGS. 1(*a*) to 1(*d*). The ends 37, 39 of the bar 14 extend outside of the housing 12 to be embedded directly into the surrounding concrete.

According to the preferred embodiment, retaining bar 14 is made of metal and is formed with notches 50, 52, 54, 56. The notches assist in retaining the bar in embedment in the concrete mass. Certain of the notches may also be used to secure retaining clips 57 around the bar at locations designed to prevent the bar from migrating into the concrete (for example when a vibrator is applied to the concrete. The retaining clips 57 abut the sides of the apertures 36, 38 to prevent movement of the bar in relation to the apertures.

In the preferred embodiment, there is also provided a removable bridge 16 that is dimensioned to rest on two opposing grooves 23 located on the collar 22 and to span the cavity of the housing. A central cutout 58 in the bridge 16 is adapted to receive a portion of the bar 14 and to hold the latter in place against swiveling within the apertures 36, 38, which may occur during vibration of the concrete. Once the concrete has set and the forming wood is removed, the bridges 16 may be removed.

When in use with a safety rope or harness, the curved bar 14 provides a point of attachment for safety equipment, with the curvature tending to center the shackle or other attachment device on the bar while nonetheless allowing some limited movement.

Testing has shown that the use of the curved bar for embedment results in significant resistance to withdrawal of the bar and the housing from the concrete and it has a tendency to straighten when pulled upon. In 25 megapascal unreinforced and unvibrated concrete, the system started to yield under a load of 34 kN. The anchor was intact and it was the concrete that yielded. The tests used a polypropylene anchor housing with an embedded depth of 2.69", and a 0.160" thick wall that diverges upward at an angle of 20°, a 304 stainless steel retaining bar with a diameter of 0.75" and an arc length of 180° having a radius of 4 inches. The inventor postulates that the effect of the curvature of the retaining bar provides a multi-angled contact area with the surrounding concrete and tends to maintain the overall integrity of the concrete when attempting to withdraw the anchor. In any event, the anchor of the invention does display sufficient retention in the concrete to meet regulatory requirements.

The system of the invention is easy to use. The retaining bar 14 is inserted into the hole 36 on one side of the housing, and threaded into the opposite hole 38, which can be done at the worksite. Retaining clips 57 may be used to retain bar 14 in the appropriate location through holes 36, 38. The anchor is then nailed to the wood formwork using holes 27. Bridge 16 is installed to hold bar 14 centered in the housing during the subsequent concrete pouring and vibrating. The housing is permanently embedded in the concrete up to its collar and such that the surface of the surrounding concrete is flush with the top of the flange 30. When the concrete has set, the bridge 16 may be removed, leaving the housing and the retaining bar permanently embedded in the concrete. The A fall protection safety rope or lanyard may be attached to the portion of the retaining bar 14 that spans the void within the housing. Because of the curvature of the bar, the rope or lanyard tends to center itself along the bar.

The flanges 30 may be supplied in multiple widths such as 3/16", 7/8" and 2" to accommodate varying roofing requirements for vertical and horizontal applications.

The invention provides an effective, easy to use and remarkably strong anchor and provides a curved attachment point for accommodating and self-centering to some extent, safety ropes or shackles. Multiple housings may be stacked within one another for easy transport and storage. When not in use for fall protection, the cover is applied to present a flat aspect with the surrounding concrete.

In the foregoing description, exemplary modes for carrying out the invention in terms of examples have been described. However, the scope of the claims should not be limited by those examples, but should be given the broadest interpretation consistent with the description as a whole. The specification and drawings are, accordingly, to be regarded in an illustrative rather than a restrictive sense.

The invention claimed is:

1. A fall protection safety anchor assembly for permanent embedment of said assembly in a concrete surface after concrete forming said concrete surface has set, comprising:

a unitary housing having a circular upwardly diverging side wall and an interior upwardly open cavity defined by said side wall;

opposed apertures in said side wall;

a uniformly curved retaining bar adapted to be inserted through said opposed apertures and through said cavity with the ends of said bar extending outside said cavity for embedment in concrete.

2. The assembly of claim 1, said side wall terminating at an upward end in an outwardly extending collar that is adapted to receive a cover engageable on said collar.

3. The assembly of claim 1 wherein said wall terminates at a downward end in a flat base, said wall and said base defining a frusto-conical shape.

4. The assembly of claim 1 wherein said wall terminates at a downward end in a flat base, said wall and said base defining a frusto-spherical shape.

5. The assembly of claim 2 wherein said collar comprises a channel for receiving an O-ring.

6. The assembly of claim 1 wherein said bar comprises a plurality of notches.

7. A fall protection safety anchor assembly for permanent embedment of said assembly in a concrete surface after concrete forming said concrete surface has set, comprising:

a unitary housing having at least two upwardly diverging side walls and an interior upwardly open cavity defined by said side walls;

opposed apertures in said side walls;

a uniformly curved retaining bar adapted to be inserted through said opposed apertures and through said cavity with the ends of said bar extending outside said cavity for embedment in concrete.

8. A method of supplying a permanently embedded fall protection safety anchor in a concrete surface, comprising:

providing a frusto-spherical unitary housing having a circular upwardly diverging side wall defining an upwardly open interior cavity, and opposed apertures in said side wall;

installing said housing in said concrete surface before concrete forming said concrete surface has set, and such that said cavity opens to the exterior of said concrete surface;

installing a uniformly curved retaining bar through said apertures and through said cavity before said concrete has set, such the ends of said retaining bar protrude through said apertures outside said cavity and are embedded in said concrete;

allowing said concrete to set with said housing and said retaining bar embedded in said concrete surface.

9. The method of claim 8 wherein said side wall terminates in an upper end in an outwardly extending collar that is adapted to receive a substantially flat cover thereon; and further comprising a step of installing a cover on said collar.

* * * * *